US010364531B1

(12) United States Patent
Kelyman et al.

(10) Patent No.: US 10,364,531 B1
(45) Date of Patent: Jul. 30, 2019

(54) DUST HOOD

(71) Applicant: Brunn Air Systems, Inc., Memphis, TN (US)

(72) Inventors: John Kelyman, Germantown, TN (US); Anthony York, Memphis, TN (US)

(73) Assignee: Brunn Air Systems, Inc., Memphis, TN (US)

( * ) Notice: Subject to any disclaimer, the term of this patent is extended or adjusted under 35 U.S.C. 154(b) by 0 days.

(21) Appl. No.: 16/281,795

(22) Filed: Feb. 21, 2019

Related U.S. Application Data

(63) Continuation of application No. 16/011,608, filed on Jun. 18, 2018, now Pat. No. 10,246,827, which is a continuation of application No. 15/717,922, filed on Sep. 27, 2017, now Pat. No. 10,023,996, which is a continuation-in-part of application No. 15/643,303, filed on Jul. 6, 2017, now Pat. No. 10,190,259, which is a continuation of application No. 15/276,684, filed on Sep. 26, 2016, now Pat. No. 9,725,852.

(60) Provisional application No. 62/234,061, filed on Sep. 29, 2015, provisional application No. 62/505,342, filed on May 12, 2017.

(51) Int. Cl.
*D21G 9/00* (2006.01)

(52) U.S. Cl.
CPC ..... *D21G 9/00* (2013.01)

(58) Field of Classification Search
CPC .. D21G 9/00; D21G 9/02; D21F 5/181; D21F 11/145; B08B 15/002; B08B 15/023; B08B 15/206; A47L 9/244; D21H 11/005; D06F 17/00
See application file for complete search history.

(56) References Cited

U.S. PATENT DOCUMENTS

| | | | | |
|---|---|---|---|---|
| 4,875,054 | A | 10/1989 | Archer et al. | |
| 6,017,416 | A | 1/2000 | Judd | |
| 6,068,735 | A * | 5/2000 | Marchal | B08B 1/00 162/272 |
| 6,565,711 | B1 * | 5/2003 | Kleissler, Jr. | B08B 5/00 134/15 |
| 8,118,942 | B2 | 2/2012 | Featherson et al. | |
| 9,725,852 | B1 * | 8/2017 | Kelyman | D21F 7/00 |
| 10,023,996 | B1 * | 7/2018 | Kelyman | D21G 9/00 |
| 2012/0145347 | A1 * | 6/2012 | Ponka | B65H 18/00 162/281 |

OTHER PUBLICATIONS

Valmet, Inc., "Next Generation Advantage Thru-Air Technology," Dec. 26, 2014.

* cited by examiner

*Primary Examiner* — Dung Van Nguyen
(74) *Attorney, Agent, or Firm* — United IP Counselors, LLC

(57) ABSTRACT

A dust hood for a papermaking system. The hood body has a roof and depending long sidewalls. An inlet extends substantially the entirety of each of the long sidewalls. The hood includes an outlet at one end. The roof is peaked and reaches a peak line. The hood may be positioned at or near floor level and used with air ramps that drive dust toward the inlets.

12 Claims, 9 Drawing Sheets

DUST HOOD

CROSS-REFERENCE TO RELATED APPLICATIONS

This application is a continuation of U.S. application Ser. No. 16/011,608, filed Jun. 18, 2018, which is a continuation of U.S. application Ser. No. 15/717,922, filed Sep. 27, 2017. That application claims priority to U.S. Provisional Patent Application No. 62/505,342, filed May 12, 2017, and is also a continuation-in-part of U.S. application Ser. No. 15/643,303, filed Jul. 6, 2017, which is a continuation of U.S. patent application Ser. No. 15/276,684, filed Sep. 26, 2016, now U.S. Pat. No. 9,725,852. Application Ser. No. 15/276,684 claims priority to U.S. Provisional Patent Application No. 62/234,061, filed Sep. 29, 2015. All of those applications are incorporated by reference in their entireties.

BACKGROUND OF THE INVENTION

1. Field of the Invention

The invention relates to papermaking systems and processes, and more particularly, to a dust control system for a through-air drying machine.

2. Description of Related Art

Modern industrial tissue-making processes are typically performed using a single machine. In a conventional papermaking machine, on the "wet" side of the machine, a combination of plant fibers, typically some combination of virgin and recycled wood pulp, is formed by pressing between a wire mesh and a felt as it wraps around a forming roll. The wet web is transferred to a large-diameter drying cylinder, called a Yankee cylinder. The Yankee cylinder is steam-heated to high temperature to dry the wet web, and the web and is peeled from the Yankee cylinder by a scraping blade, called a doctor blade.

While the conventional process has been used successfully for many decades, a different process called through-air drying, or sometimes simply through drying, is rapidly becoming popular, particularly for tissue making. First invented in the 1960s, through-air drying involves using compressed air or vacuum to draw the moisture out of a wet paper web as it moves along a belt and around a number of compressed air or vacuum drums. A Yankee cylinder is usually still used in these processes, but by the time the wet web reaches the Yankee cylinder, its moisture content is typically very low compared with the traditional process, and so the Yankee cylinder need not be heated to as high a temperature. Compared with conventional processes, the main advantage of through-air drying is that the process produces a bulkier, softer sheet, which is particularly valuable in products like tissues and paper towels—and indeed, through-air drying is used extensively to produce "premium grade" tissues and towels.

The difficulty with through-air drying machines and processes is that they produce enormous amounts of dust. In part, this is because of the speed and scale of the process—a through-air-drying tissue-making machine may be 2.4 or 5.7 meters wide with a tissue web very nearly that wide, and it may operate at speeds of, e.g., up to 1,500 meters per minute. However, the starting materials also influence the amount of dust that is produced. In fact, the amounts of dust produced by these processes have actually increased in recent years because of the increasing use of recycled fibers, which are typically shorter than virgin fibers and are more likely to break away from the web and create dust as the web moves through the dry end of the machine. In typical use, it may be necessary to shut the process down several times in a single production shift in order to clear dust from in and around the machine, and unfortunately, fires are not uncommon.

For some time, vendors have placed systems of vacuum hoods around papermaking machines, sometimes coupled with baffles that contain the dust and protect against breakage. However, papermaking machines that use through-air drying pose special challenges, and dust control systems for these machines are not well established.

SUMMARY OF THE INVENTION

One aspect of the invention relates to a dust control system for the "dry" end of a through-air drying (TAD) papermaking system that uses a belt to move a web of formed paper or tissue from a Yankee cylinder onto a parent roll. A series of dust hoods are placed in specific locations along the path of the belt, both above and below the web of paper or tissue. Each hood spans at least a substantial portion of the width of the belt or web, and each hood is shaped and otherwise adapted for its particular position, both to accommodate the structure of the papermaking machine and to ensure that the airflow through the inlet of the hood is substantially uniform across its entire width. The airflow through each hood is predetermined based on its position, with hoods in higher-dust areas having higher airflows. Baffles are provided between certain hoods, and between hoods and certain other elements of the machine, in order to create dust-control zones around the hoods, and air ramps and other elements may be used to drive dust into the dust control zones and toward the hoods.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the drawings, and in which.

DETAILED DESCRIPTION

Figure 1:
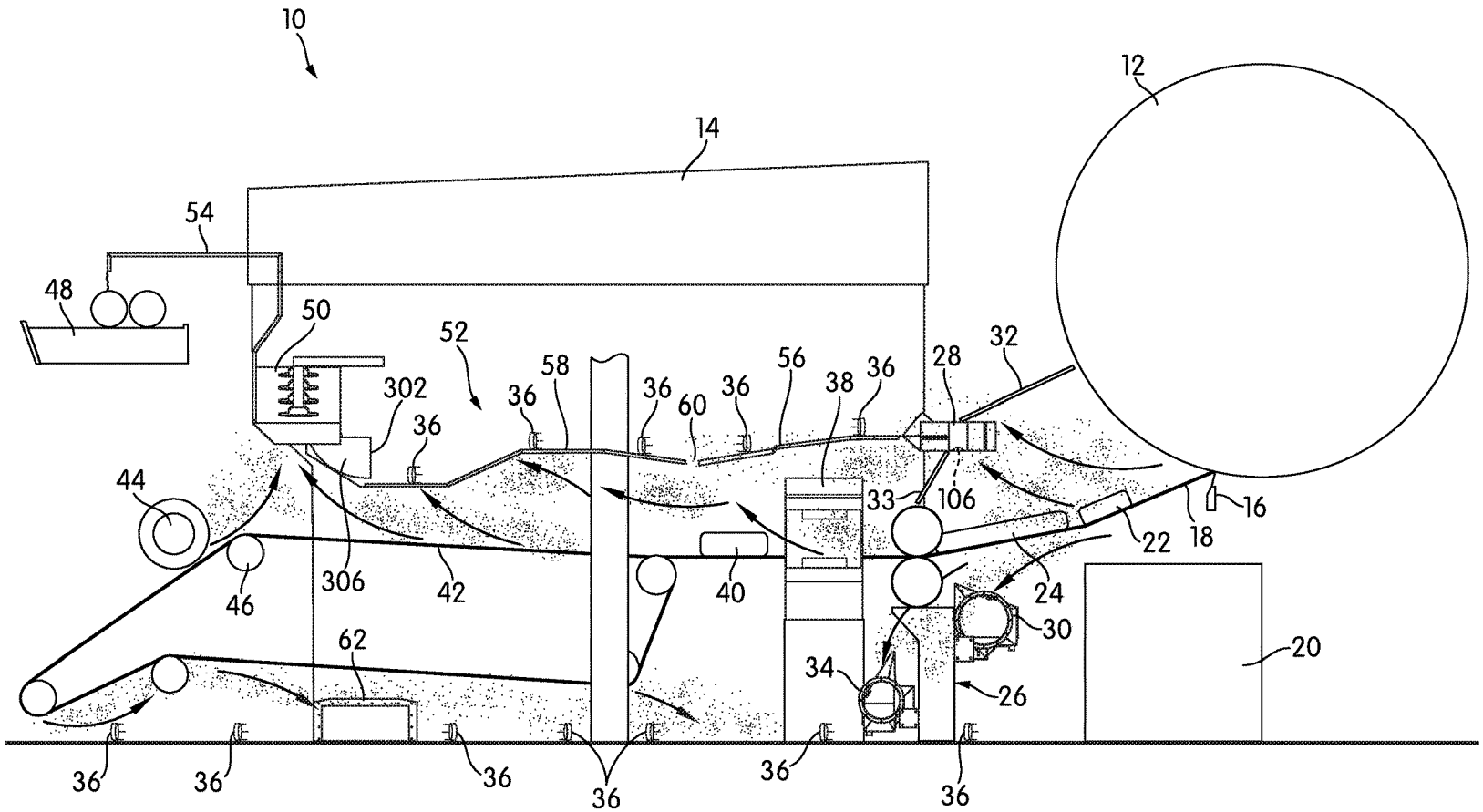
FIG. 1 is a schematic diagram of the "dry" end of a tissue-making machine employing through-air drying, illustrating dust patterns and the locations of a set of vacuum hoods and baffles that serve as a dust control system within and around the machine.

FIG. 1 is a schematic illustration of the "dry" end of a tissue-making machine, generally indicated at 10, according to one embodiment of the invention. As will be described below in more detail, the machine 10 includes a dust control system, in which a series of vacuum hoods and baffles are used to control and remove dust as the machine 10 operates. Much of the dry end of the machine 10 is under a canopy 14, which is intended to contain heat and dust from the process. However, in practice, the canopy 14 does not do much to control dust generated during operation.

The dry end of the machine 10 in the illustrated embodiment begins with a Yankee cylinder 12, although Yankee cylinders 12 need not be used in all embodiments. As was described briefly above, in the machine 10, the Yankee cylinder 12 is heated only to a relatively low temperature, because most, if not all, of the moisture reduction occurs via through-air drying before the Yankee cylinder 12. The Yankee cylinder 12 may, however, be hot enough to cure any adhesive or sheet release compound that is used to temporarily bind the web to the Yankee cylinder 12. In various embodiments, compounds ranging from poly(vinyl alcohol) (PvOH)-based adhesives to molasses may be used for these purposes, and as will be described below in more detail, these compounds tend to make the resulting dust sticky.

A conventional doctor blade 16 scrapes the web of tissue 18 from the Yankee cylinder 12. A container 20 lies under the doctor blade 16 to catch dust and detritus that falls from the Yankee cylinder 12 and the doctor blade 16. Dust begins to form in this area, called the creping area, and while the container 20 does catch some of it, a large portion of the generated dust is caught by the boundary layer of air surrounding the rapidly-moving web 18 and travels outward with it, as indicated in FIG. 1.

After leaving the Yankee cylinder 12, the web 18 next passes over foils 22, 24 that serve to remove wrinkles, smooth, and stabilize the web 18. Beyond the foils 22, 24 in the machine of FIG. 1 lies a calender stack 26. In through-air drying processes, many operators do not use a calender stack 26, if one is installed, and some through-air drying machines omit a calender stack 26 entirely.

As was described briefly above, distributed around the machine 10, and secured to parts of it, are a network of dust control features, including a series of baffles and hoods. Generally speaking, the baffles contain and direct the dust flows, and also absorb energy if the web 18 breaks. The hoods are connected to a high-volume fan or fans to draw air and dust into them by a collection of ductwork. (In FIG. 1, the ductwork has been omitted in order to show the positions of the hoods clearly.) If the hoods are connected to a single high-volume fan, a manifold or various baffles within the ducts may be used to route air selectively to the various hoods.

Both the hoods and the baffles are located where the dust flows are greatest or cause the most difficulty. The volume of air moved through each hood in a given time period depends on the amount of dust that accumulates near the position of each hood, with hoods located in dustier areas generally moving more air volume in a given time period than hoods located in less dusty areas. As will be described below in more detail, the airflow velocity within the ductwork may be kept above a certain predefined velocity in order to prevent dust from accumulating within the ducts.

Ultimately, dust caught by the hoods is sent to a scrubber, after which the captured dust may be either recycled into the wet side of the machine and re-used or disposed of. For simplicity in illustration, the filter, scrubber, and ductwork that lead to them are not shown in FIG. 1 or the other drawing figures.

In this dust control system of hoods and baffles, the first two hoods 28, 30 are located between the Yankee cylinder 12 and the calender stack 26. Hood 28 is located above the web 18, while hood 30 is below the web 18. Both hoods 28, 30 are assisted by natural air currents to capture dust that is generated by sheet release at the Yankee cylinder 12 and the foils 22, 24. In order to form a control zone, isolate the area around the Yankee cylinder 12, and control the dust, a baffle 32 is attached to the hood 28 and extends between the Yankee cylinder 12 and hood 28. A second baffle 33 attached to the underside of the hood 28 extends downward toward the calender stack 26. The two baffles 32, 33 constrain and control the path of the dust liberated around the Yankee cylinder 12 and the foils 22, 24.

The particular shape and features of the hoods 28, 30 will be described below in more detail. Generally speaking, though, the hoods 28, 30 and their placements illustrate several things about dust control systems according to embodiments of the invention: dust flows both above and below the web 18 are considered and addressed, each hood is particularly shaped and adapted for its placement, and hoods may have any number of inlets so as to simultaneously address dust flows in multiple directions. Additionally, as will be described below in more detail, baffles 32, 54, 58 attached to the hoods 28, 30 and proximate to them are used to create control zones that capture and control dust, resulting in an increase in the efficiency of each hood 28, 30.

Immediately beyond the calender stack 26, located toward the floor level, is a third dust hood 34. Proximate to the third dust hood 34 along the floor are a series of air ramps 36—compressed air sources that are provided to blow accumulated dust toward the third dust hood 34. While the air ramps 36 can be operated continuously in some embodiments, it is typically more advantageous to operate the air ramps 36 on a pulsed cycle, providing compressed air for a few seconds every few minutes, for example, because generating and storing compressed air is an energy-intensive endeavor.

Beyond the calender stack 26, the web 18 passes through a scanner 38, which checks the web 18 for dryness and uniformity, and then passes under another foil 40. After the foil 40, the web 18 is picked up by an endless belt 42, although in other embodiments, a hard reel drum may be used instead. The belt 42 conveys the web 18 to a winding reel 44, which winds the dried web 18 into a parent roll of tissue. The parent roll is stored and subjected to further processing to create a final tissue product. The use of a belt 42, instead of a collection of hard rollers, helps to maintain the bulk, softness, and other properties of the web 18. The belt 42 may have any number of drive pulleys and any number of idler pulleys, typically with at least one drive pulley 46 located near the winding reel 44. Over the area of the winding reel 44, a shelf 48 may be provided to store parent rolls and other components.

The belt 42 can be a significant dust generator—especially in areas where there is a bend in its path. Thus, a fourth dust hood 50 is located above the belt 42, proximate to the winding reel 44. As was described briefly above, in order to provide a "dust control zone" along the path of the web 18, a series of baffles 52 runs between the first hood 28 and the fourth hood 50, above the web 18, with baffles 52 attaching to each of the two hoods 28, 50. Beyond the fourth hood 50, a section of baffle 54 rises up, making a 90° bend and terminating above the shelf 48. The baffle 54 forms a control zone to capture and reduce the energy of tissue pieces broken free of the parent roll during a sheet break. The dust and broken pieces are contained and controlled by baffle 54 and are ultimately forced down into the inlet of hood 50, thus increasing the capture efficiency of hood 50.

As can be seen in FIG. 1, in the illustrated embodiment, the baffles 52 include two major sections of baffling 56, 58 with a break 60 between them proximate to the fourth hood 50. Mounted atop the baffles 56, 58 are a series of air ramps 36. Proximate to the first hood 28, the air ramps 36 are positioned to drive dust toward and into the first hood 28. However, as can also be seen in FIG. 1, along much of the rest of the length of the baffles 56, 58, the air ramps 36 are positioned to drive dust toward the break 60 between the baffles 56, 58. Thus, the air ramps 36 essentially drive any accumulated dust back down into the dust control zone created by the hoods 28, 50 and baffle system 52. As with the other air ramps 36, these air ramps 36 may be pulsed for a few seconds (e.g., 10-15 seconds) every few minutes, instead of being used in continuous operation.

The belt 42 undergoes a number of relatively sharp bends beyond the winding reel 44 as it returns to once again pick up the web 18. As was described briefly above, each time the belt 42 bends, there is more possibility of dust being thrown off. Additionally, dust residue under the web 18 that remains on the belt 42 after the parent roll captures the web 18 travels with the belt 42, because of the boundary layer of air that surrounds the belt in operation. This dust gradually falls off the belt 42 and accumulates below it. Between that and the natural action of gravity, the area under the belt 42 can collect significant amounts of dust. Therefore, in the illustrated embodiment, a fifth dust hood 62 is provided in the area under the belt 42. Dust hood 62 is usually disposed on the floor, or very near it, and may have upper surfaces shaped to provide clearance for the belt 42, as the belt runs directly over it in close proximity. As was described above, a series of air ramps 36 is provided along the floor. The air ramps 36 closest to hood 34 are directed so as to drive dust toward and into hood 34; however, closer to hood 62, the air ramps 36 are directed to drive dust into hood 62.

In embodiments of the invention, the size, shape, and general configuration of each hood 28, 30, 34 50, 62 will vary considerably from that of the others, and the airflow through each hood 28, 30, 34, 50, 62 will typically be different. However, each hood 28, 30, 34, 50, 62 has at least one inlet—in the form of a slot, much wider than it is high—that accepts both dust and pieces of tissue or paper that break free.

Because the hoods 28, 30, 34, 50, 62 are designed to fit within the machine 10 in close quarters to operating components, the locations of the air inlet and the air outlet (to a duct) are selected on a case-by-case basis. For example, the air outlet in a hood may be at one end of the hood, and a sharp turn or turns may be needed in order to connect the outlet to an appropriate duct. Because each hood 28, 30, 34, 50, 62 will typically be several meters wide, the shape of the body of each hood 28, 30, 34, 50, 62 is selected to maintain at least substantially uniform flow of air across the entire hood inlet. Differences in flow across the inlet can create differential pressures on the web 18, which can cause the web 18 to tear.

In this case, the phrase "substantially uniform flow of air" alludes to the fact that absolute uniformity of airflow across the width of the inlet, while theoretically possible, is usually practically impossible. This is because each hood 28, 30, 34, 50, 62 has its own unique shape and size constraints, stemming from its location and where and how it is supported and installed. Thus, a "substantially uniform flow of air" refers to an airflow across the width of an inlet uniform enough that any differential pressure induced on the web 18 does not cause the web 18 to tear. Airflow variations of, e.g., 10% or more may be tolerated, depending on the particular hood 28, 30, 34, 50, 62 and its location.

The following description focuses on the characteristics of the individual hoods 28, 30, 34, 50, 62, addressing each hood 28, 30, 34, 50, 62 in turn. As was noted above, for simplicity in description, the connecting ductwork is not shown, but the outlet of each hood 28, 30, 34, 50, 62 would be connected to a duct, and the ductwork would typically be arranged to accommodate the baffles 52 and other features.

Figure 2:
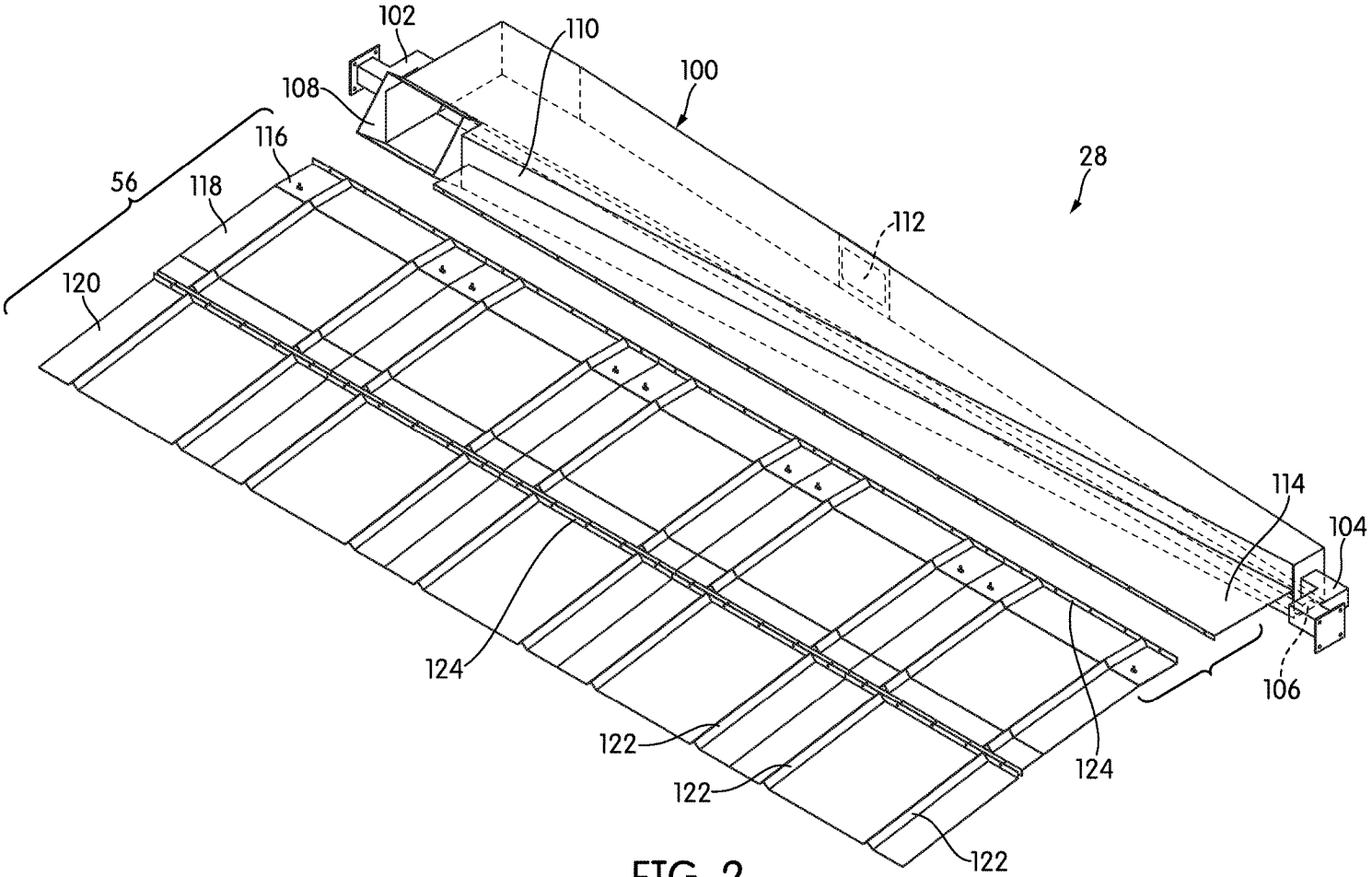
FIG. 2 is a perspective view of a first dust hood.

FIG. 2 is a perspective view of the first hood 28, which is positioned between the Yankee cylinder 12 and the calender stack 26 above the web 18. Hood 28 has a multisided hood body 100 that uses an aspect ratio which closely resembles a trapezoidal prism. Brackets 102, 104 are provided at each end of the body 100 to secure the hood 28 to the machine 10. Typically, hood 28 would be positioned very close to the Yankee cylinder 12, e.g., slightly less than two feet (0.6 m) away.

The inlet 106 and outlet 108 are both located along the front face 110 of the body 100. The outlet 108 is positioned along the front face 110 adjacent to the widest portion of the body 100, and comprises a short duct that makes a sharp turn upward with respect to the plane of the front face 110. (As a general matter, outlets are typically located at the wide (or wider) end of the hood body 100 if the machine configuration permits that position.) The hood 28 has a single inlet 106 in the form of an elongate slit, which extends along the bottom face of the hood body, beginning adjacent to the outlet 108 and extending substantially the entire length of the hood body 100.

Because the outlet 108 is at one end of the hood body 100, and also because it makes a sharp turn with respect to the body 100, if the hood body 100 were a rectangular prism, there would likely be a large pressure drop across the width of the inlet 106. However, the hood body 100 tapers down significantly in depth, going from, e.g., 31.125 inches (79.1 cm) at the widest part to 7.875 inches (20 cm) at the narrowest. In the illustrated embodiment, the front face 110, where the inlet 106 and outlet 108 are located, is the angled, tapering face.

The body 100 does, however, maintain a constant height (e.g. about 1 foot (30.5 cm)) across its entire width. Overall, the length of the hood body 100 roughly matches the operating width of the machine—about 18.9 feet (5.8 meters).

The inlet 106 also varies in height across its width. More specifically, as shown in the front elevation of FIG. 3, in order to maintain uniform flow through the inlet 106, the inlet 106 is shortest (i.e., narrowest) close to the outlet 108 in the widest part of the body 100, and tallest (i.e., widest) at the narrow far end of the body 100.

Toward its rear, the hood body 100 includes a hatch or port 112 to allow for cleaning. In typical operation, the hood 28 may have an outlet flow of about 9500 CFM (269 $m^3$/min). The airflow rate through the hoods may vary from embodiment to embodiment, and even from production run to production run, depending on the dust loading of the TAD sheet or web 18 that is being produced. As was described above, among other factors that influence a sheet's dust loading, sheets produced with more recycled fibers typically produce more dust. The airflow rate through the various hoods is also determined, in part, by the hood's position within the machine 10, with certain areas or process steps naturally generating more dust. In relative terms, hood 28 of the illustrated embodiment is one of the lower-volume hoods; hoods 50 and 62, for example, may have airflow rates that are double or triple that of hood 28.

FIG. 2 also illustrates some of the baffles 56 that are connected to and associated with the hood 28. In the view of FIG. 2, the baffles 32, 33 that extend between the hood 28 and the Yankee cylinder 12 and between the hood 28 and the calender stack 26 are omitted so as not to obscure the features of the hood 28 itself.

More specifically, the baffles 56 that attach or are coupled to the hood 28 include a short section of baffle 114 attached to the front face 110 of the hood body 100 that projects outwardly from it. In the illustrated embodiment, this section of baffle 114 is a flat, trapezoidal section of metal that is narrowest where the hood body 100 is widest and widest where the hood body 100 is narrowest.

As was described briefly above, dust control systems according to embodiments of the invention use long sections of baffling to create dust control zones that contain dust flows and drive those flows toward the inlets of the hoods 28, 30, 34, 50, 62. Because the baffles are long and extend the full width of the machine 10, it is often very helpful to construct the baffles in sections. FIG. 2 illustrates this general principle—the baffles 56 attached or coupled to the hood 28 also include three sections of baffle 116, 118, 120 that are connected to each other and are shown in FIG. 2 exploded away from the hood body 100 and short baffle section 114.

The view of FIG. 1 is schematic in some aspects, as it omits certain details of the machine 10, like support beams and surrounding structure, to focus on the placement of the various hoods 28, 30, 34, 50, 62 and the dust control zones around them. In some cases, the machine 10 may have a structural beam adjacent to the hood 28. If such a beam is present, the baffle 56 that is connected or coupled to the hood 28 may need to be broken up into pieces in order to make a seal around the beam or other pre-existing structure. That is one reason why baffle section 114 is shown in FIG. 2 as exploded away from the other baffle sections 116, 118, 120—these sections of baffle 56 may cooperate, but may not be physically attached to one another in some embodiments. The baffle sections 114, 116, 118, 120 shown in FIG. 2 also illustrate a general point: while it is preferable for a dust control zone to extend the full width of the web 18 or the full width of the machine 10, some individual sections of baffle may need to be narrowed to accommodate structure within the machine or to attach at particular points, or they may need to have specific contours or cut-outs to accommodate parts of the machine 10.

Each section of baffle 116, 118, 120 has regularly spaced stiffening ribs 122 that are arranged to be contiguous across sections of baffle 116, 118, 120. Each section of baffle 116, 118, 120 extends the full width of the hood 28; the breaks between them are transverse (i.e., width-wise), and the individual sections include short, raised flanges 124 for fastening. Any suitable means of fastening may be used, including welding, brazing, adhesives, or fasteners, like rivets or machine screws. Assembled, the three sections of baffle 116, 118, 120 form the baffle 32 that controls dust between the Yankee cylinder and the hood 28, extending about 71.5 inches (181.6 cm) from the hood 28. The assembled baffle 32 may have a gentle downward slope to drive any accumulated dust down into the opening. The baffles 56, 58 themselves may be attached to the machine using brackets, rods, or any other convenient structures, and will typically be suspended from above, although in some cases, support from below may be used.

Figure 3:
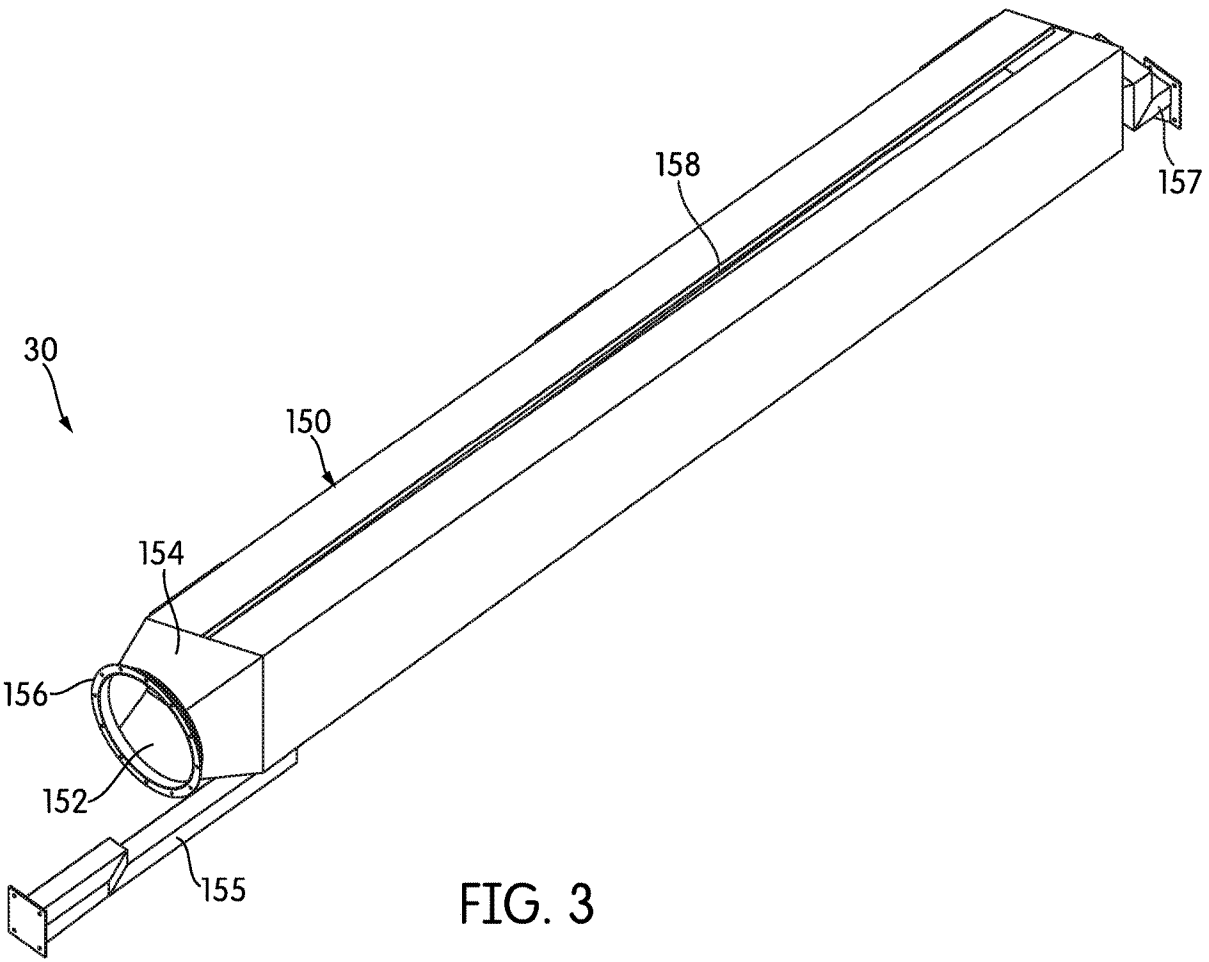
FIG. 3 is a perspective view of a second dust hood.
Figure 4:
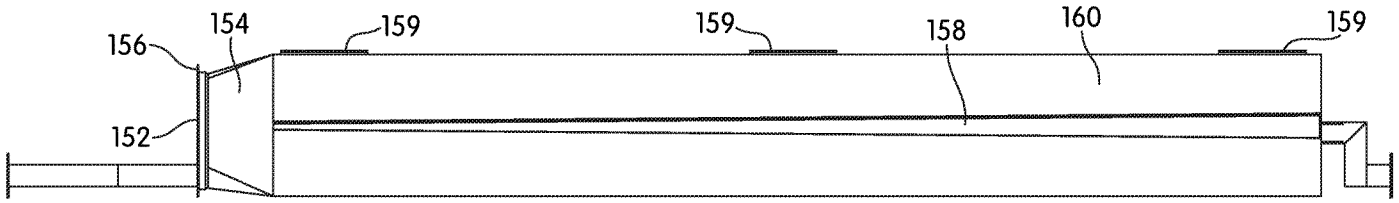
FIG. 4 is a top plan view of the dust hood of FIG. 3.
Figure 5:
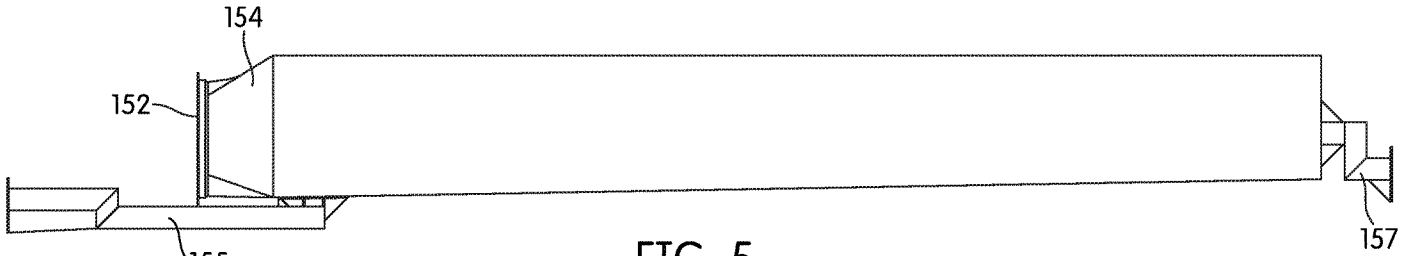
FIG. 5 is a rear elevational view of the dust hood of FIG. 3.

FIG. 3 is a perspective view of hood 30 in isolation, and FIGS. 4 and 5 are top plan and rear elevation views, respectively, of hood 30. In hood 30, the main portion of the hood body 150 most closely resembles a tapering trapezoidal prism—it has four long sides of unequal area and two end faces, and tapers along its width.

The outlet 152 of the hood 30 is round and located in one end face of the hood 30, connected to the main portion of the hood body 150 by an adapter section 154. The outlet 152 includes a ring flange 156 for connection to ductwork. The main portion of the hood body 150 may be, e.g., 191.8 inches (4.87 m) wide, with the adapter section 154 extending another 14 inches (35.6 cm). As shown in FIGS. 3 and 4, additional support brackets 155, 157 extend from each end of the hood body 150, giving the entire assembly a width of 253.5 inches (6.4 meters). In a typical installation, hood 30 would be installed, e.g., 28.675 inches (72.8 cm) back from hood 28. As illustrated in FIG. 1, hood 30 typically about 39 inches above ground level.

As a general matter, the inlet placement on each hood is unique and is determined by observation of dust patterns at each location on the machine. To the extent possible, inlets should be positioned to take advantage of natural air currents that entrain and direct dust. As can be seen particularly in FIGS. 3 and 4, the inlet 158 of hood 30 is located in the top face 160 of the hood body 150, in line with the horizontal centerline of the hood body 150. The reason for this inlet placement can be appreciated from FIG. 1—hood 30 is located beneath the web 18, and thus receives dust from above. The inlet 158 itself is a tapering slit, narrowest close to the outlet 152 and widest at the opposite end of the hood body 150. As was explained above, this keeps the flow constant across the entire length of the inlet 158. The inlet 158 may be, for example, 1.25 inches (3.175 cm) at the narrowest and 4 inches (10.16 cm) at the widest, close to the outlet 152. Thus, the hood body 150 and the inlet 158 have opposite tapers.

FIG. 5 illustrates most clearly the taper in the hood body 150 of the hood 30: along its width, it has about a 21° taper, reducing its height from the outlet end to the far end. The reduced internal volume helps to keep the airflow constant across the entire inlet 158.

Figure 6:
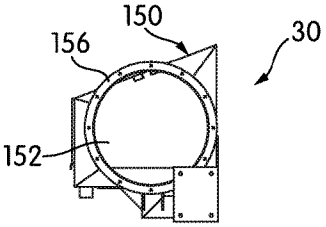
FIG. 6 is a side elevational view of the dust hood of FIG. 3.

FIG. 6 is a side elevation of hood 30, taken from the side with the outlet 152. As shown, the hood body 152 has a trapezoidal shape when viewed from the end, and comes to a relatively sharp peak at its rearmost upper point, sloping down toward the front. (Here, the "front" of the hood 30 faces the Yankee cylinder 12; the rear is opposite the front.) The relatively sharp peak and downslope between the rear and the front may help to drive accumulated dust down toward the inlet 158.

Each hood 28, 30, 34, 50, 62 has at least one hatch or inspection port for interior access and cleanout. The hatches 159 of hood 30 can best be seen at the top of FIG. 4.

Because of its positioning, hood 30 typically sees more dust than hood 28. Thus, hood 30 has a higher flow across the inlet of approximately 14,000 CFM (396 $m^3$/min), greater than that of hood 28. As was explained above, airflow rates in any given situation will depend on the dust loading of the sheet that is being produced, as well as hood location.

Figure 7:
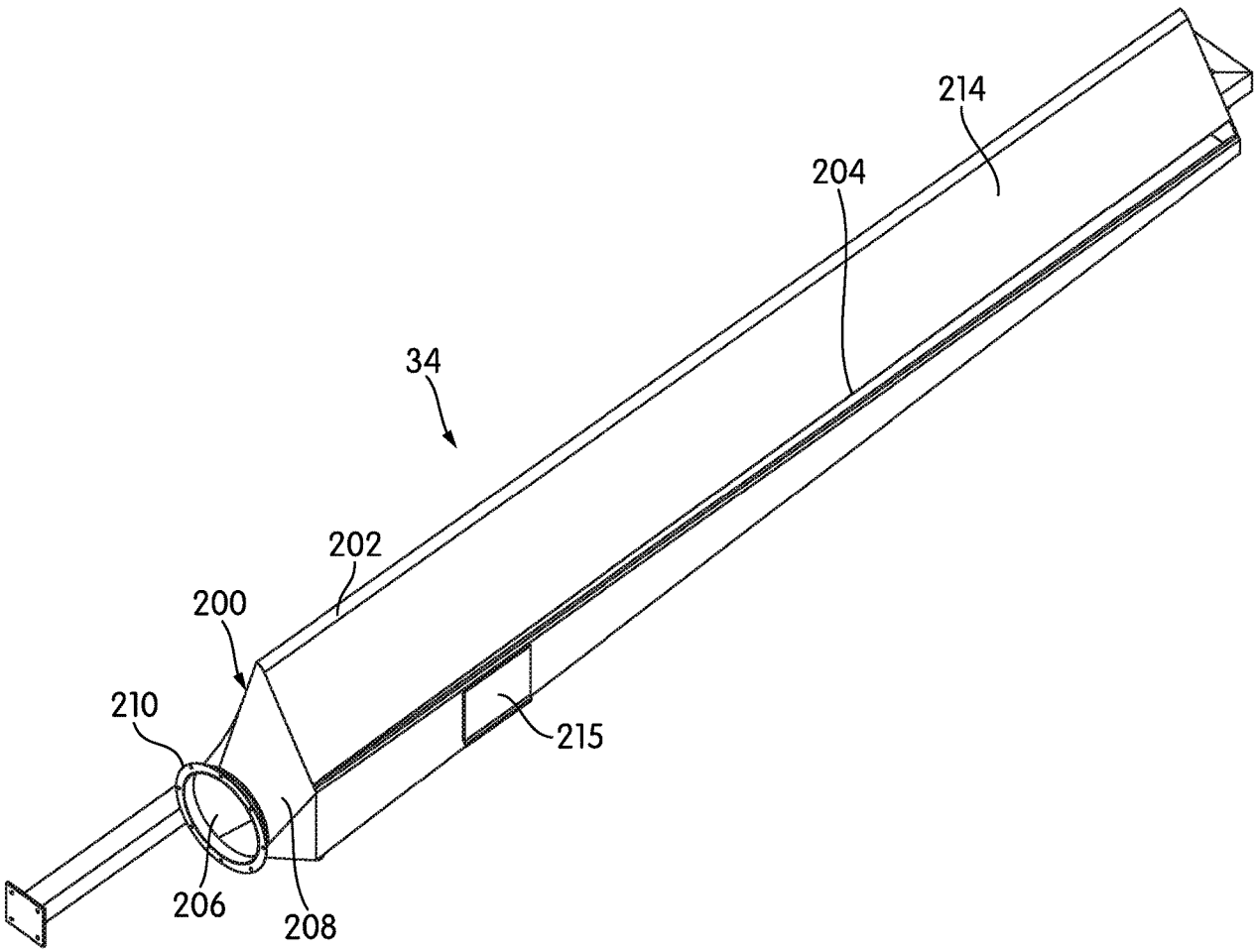
FIG. 7 is a perspective view of a third dust hood.

FIG. 7 is a perspective view of hood 34 in isolation. Hood 34 has a hood body 300 with a complex shape. Somewhat like hood 30, it comes to a sharp peak 202, making an angle A of about 58 degrees, and slopes down from the peak to its inlet 204, which is located on the front face of the body 300. The steep angle is used to assist in removal of dust that may accumulate between the hood top and the inlet 204—TAD dust can be sticky, and the sharp peak 202 helps to drive it toward the inlet 204.

The outlet 206 is round, connected to one end of the hood body 200 by a tapering adapter section 208, and has a ring flange 210 for connection to ductwork. In order to maintain even pressure across the width of the hood 34, the inlet 204 grows in size across the width of the hood 34—narrowest near the end with the outlet 206 and widest at the opposite end. The aspect ratio of the inlet 204 may be the same or approximately the same as the inlet 158.

Figure 8:
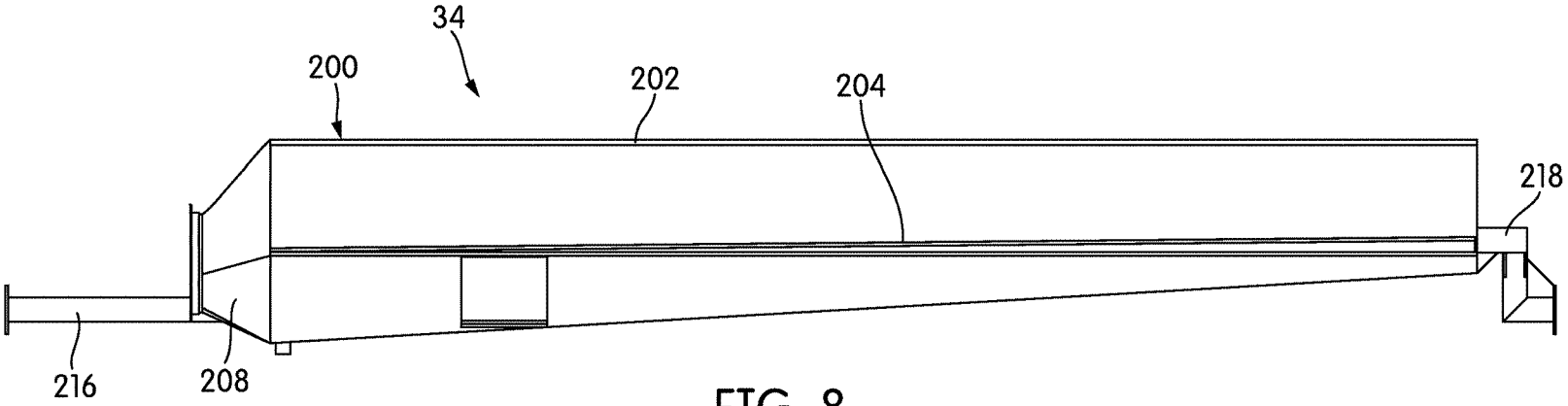
FIG. 8 is a front elevational view of the third dust hood.
Figure 9:
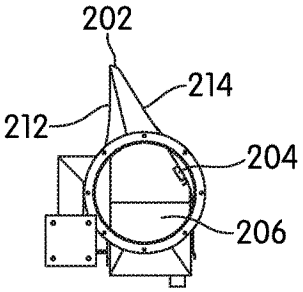
FIG. 9 is a side elevational view of the third dust hood.

As can be seen in FIG. 8, in order to maintain even pressure and flow across the width of the inlet 204, the hood body 200 tapers down in height across its width: the hood body 200 has its greatest height proximate to the inlet 206 and tapers down, with a minimum height farthest from the outlet 204. In one embodiment, for example, the hood body 200 may have a maximum height of 40.5625 inches (103.02 cm) and a minimum of 34.44 inches (87.47 cm). The depth of hood 34 remains unchanged across its width and may be, e.g., between 9 and 10 inches (22.9-25.4 cm). FIG. 9 is a side elevational view of hood 34, illustrating, among other things, the angle A of the peak 202.

Typically, as illustrated in FIG. 1, hood 34 would be placed on the opposite side of the calender stack 26 from hood 30, and would typically be oriented such that its tall side 212 faces the calender stack 26 and its inlet 204 faces away from the Yankee cylinder 12. Because of the positioning of hood 34, most dust comes to it from above. Therefore, the sharp peak 202 and sloped face 214 beneath it are intended to drive most accumulated dust down and into the inlet 204. Hood 34 may operate with a lower airflow than hood 30—in one embodiment, for example, about 8000 CFM (226.5 $m^3$/min), although again, airflow rates in any given situation will depend on the dust loading of the sheet that is being produced, as well as hood location. Excepting the adapter section 208, the hood body 200 may have a width of, e.g., 197.625 inches (502 cm), and with connecting brackets 216, 218 may extend a total of 253.5 inches (6.4 m). The cleanout hatch 215 of hood 34 is best shown in FIG. 7—close to the wider end of the hood 34, just below the inlet 204.

Figure 10:
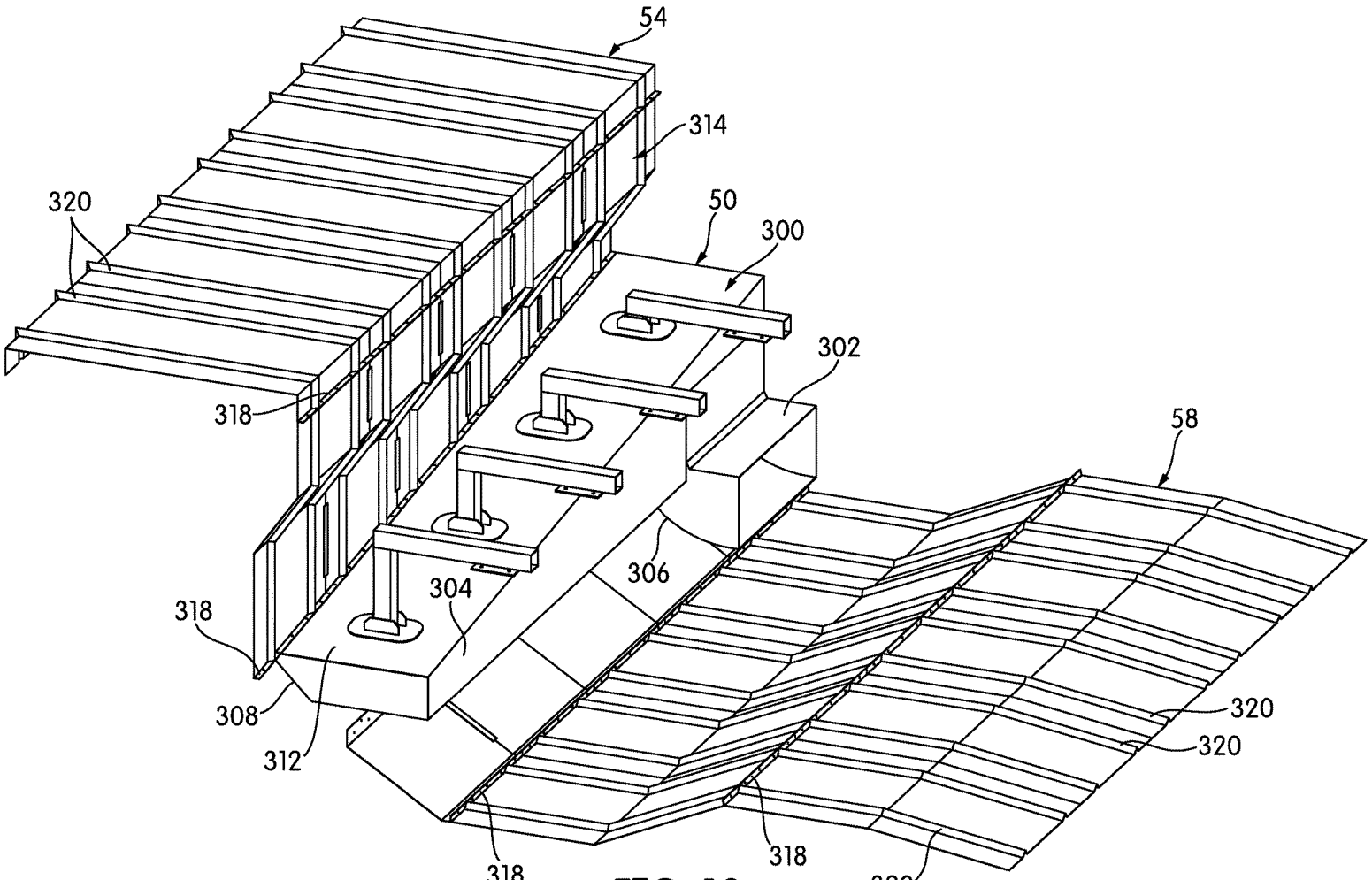
FIG. 10 is a perspective view of a fourth dust hood.

FIG. 10 is a perspective view of hood 50, shown attached to sections of baffle 54, 58, as was described above. The body 300 of hood 50 has a complex shape and, like the other hoods 28, 30, 34, tapers across its width to maintain constant inlet pressure.

The locations of outlets will vary, and may be either in the center of a hood body 100, 150, 200, 300 or at the wide end, depending on the machine frame and configuration. For hood 50, an optimal outlet placement would be in the center of the hood body 200; however, the configuration of the machine 10 prevents that. Thus, the outlet 302 of the hood lies along one end of the rear face. Immediately prior to the outlet 302 is a short duct 306 that makes a 90° turn. The outlet 302 itself is rectangular and about 46.275 inches (117.8 cm) by 19.3 inches (49.05 cm). The outlet 302 and its duct 306 hang below the body 300 of hood 50 and fit into the space between the body 30 of hood 50 and the baffle 58 to which it is connected.

The body 300 of hood 50 is primarily a tapering trapezoidal prism, tallest at the end with the outlet 302 and shortest at the opposite end. In the illustrated embodiment, the body 300 shortens in height from 31.375 inches (79.69 cm) at the broad end to 22.06 inches (56.04 cm) at the short end, over a width of 203 inches (515.6 cm). However, as can be seen in FIG. 10, the body 300 of hood 50 is not a perfect trapezoidal prism: the front face 308 is angled such that the top edge of the front face 308 juts outward.

Figure 11:
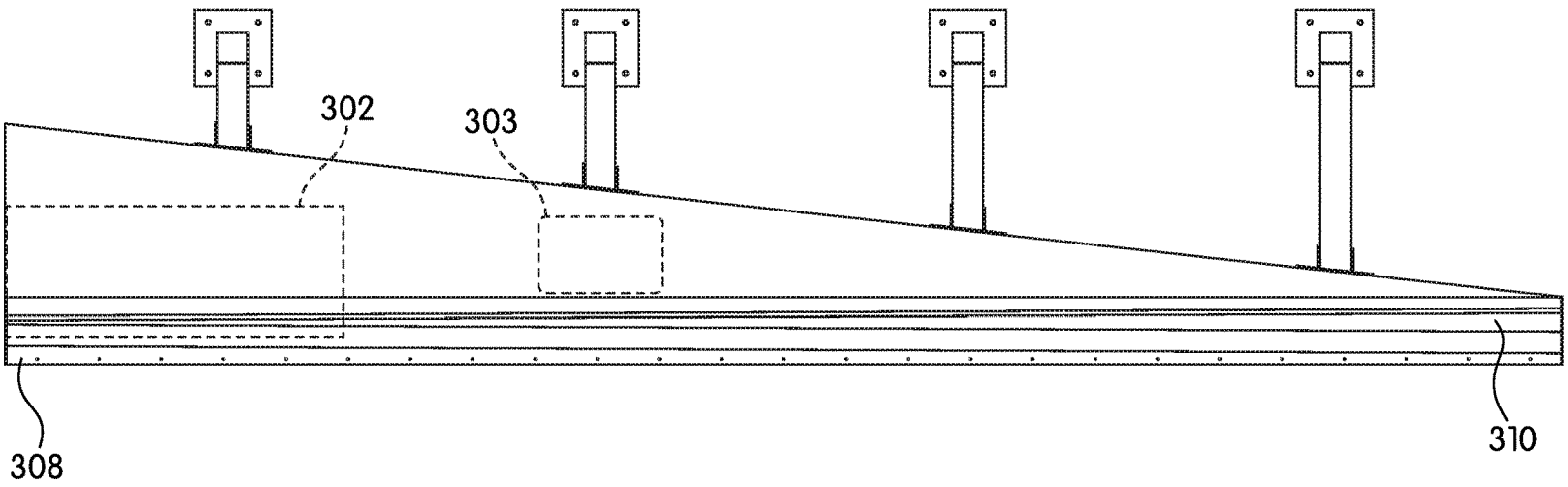
FIG. 11 is a front elevational view of the fourth dust hood.

FIG. 11 is a front elevation view of the hood 50, showing the front face 308 of the hood body 300 and the inlet 310. The inlet 310 is broadest (6 inches; 15.24 cm) where the hood body 300 is shortest and narrowest (3 inches; 7.62 cm) where the hood body is tallest. The front face 308, in which the inlet 310 sits, makes an angle of about 135° with the bottom face of the hood body 300, as shown in FIG. 10. While there is a single inlet 310 in the illustrated embodiment, other embodiments of hood 50 may include a second inlet across the bottom face. The position of the outlet 302 and of the cleanout hatch 303 are shown in phantom in FIG. 11.

In a typical installation, hood 50 would be positioned almost directly over the winding reel 44 with a clearance of less than 30 inches (76.2 cm), e.g. 28.675 inches (72.8 cm) from the reel belt 42. Hood 50 may have an airflow volume through the inlet 308 of, e.g., 28,000 CFM (792.9 $m^3$/min).

In FIG. 10, the hood 50 is shown with its baffles 54, 58. Baffle 54 is attached to the top face 312 of the hood body 300, near the front face 308, and rises up from there in a section 314 that is at least substantially vertical, reaching a total height in the illustrated embodiment of about 77 inches (195.6 cm), measured from the bottom of the hood body 300. Notably, while the hood body 300 tapers considerably in height across its width, the vertical section 314 of the baffle 54 has a corresponding inverse taper, longest at the shortest height of the hood body 300 and shortening as the hood body 300 height increases, so that the baffle 54 as a whole maintains a constant height across its width.

As was described briefly above, the baffle 54 makes a 90° turn and, in the illustrated embodiment, extends horizontally outward for a distance, e.g., 58.6 inches (146.8 cm). Because the vertical section 314 is not entirely vertical—one portion of it angles rearwardly—the baffle 54 as a whole resembles a question mark.

Baffle 58 attaches to the bottom surface of hood 50 and undulates outward toward hood 28, in this case approximately 142 inches (360.7 cm). The undulation provides clearance for ducts and other elements. Because of its undulation, portions of the baffle 58 may extend much closer to the belt 42 than any of the hoods. For example, at its lowest point, baffle 58 may come within 17 inches (43 cm) of the belt 42.

As was described briefly above, both baffles 54, 58 are constructed in segments, with flanges 318 to connect them and longitudinal stiffening ribs 320 in the segments. Along their lengths, the baffles 54, 58 may be attached to or suspended from cross-machine members.

Figure 12:
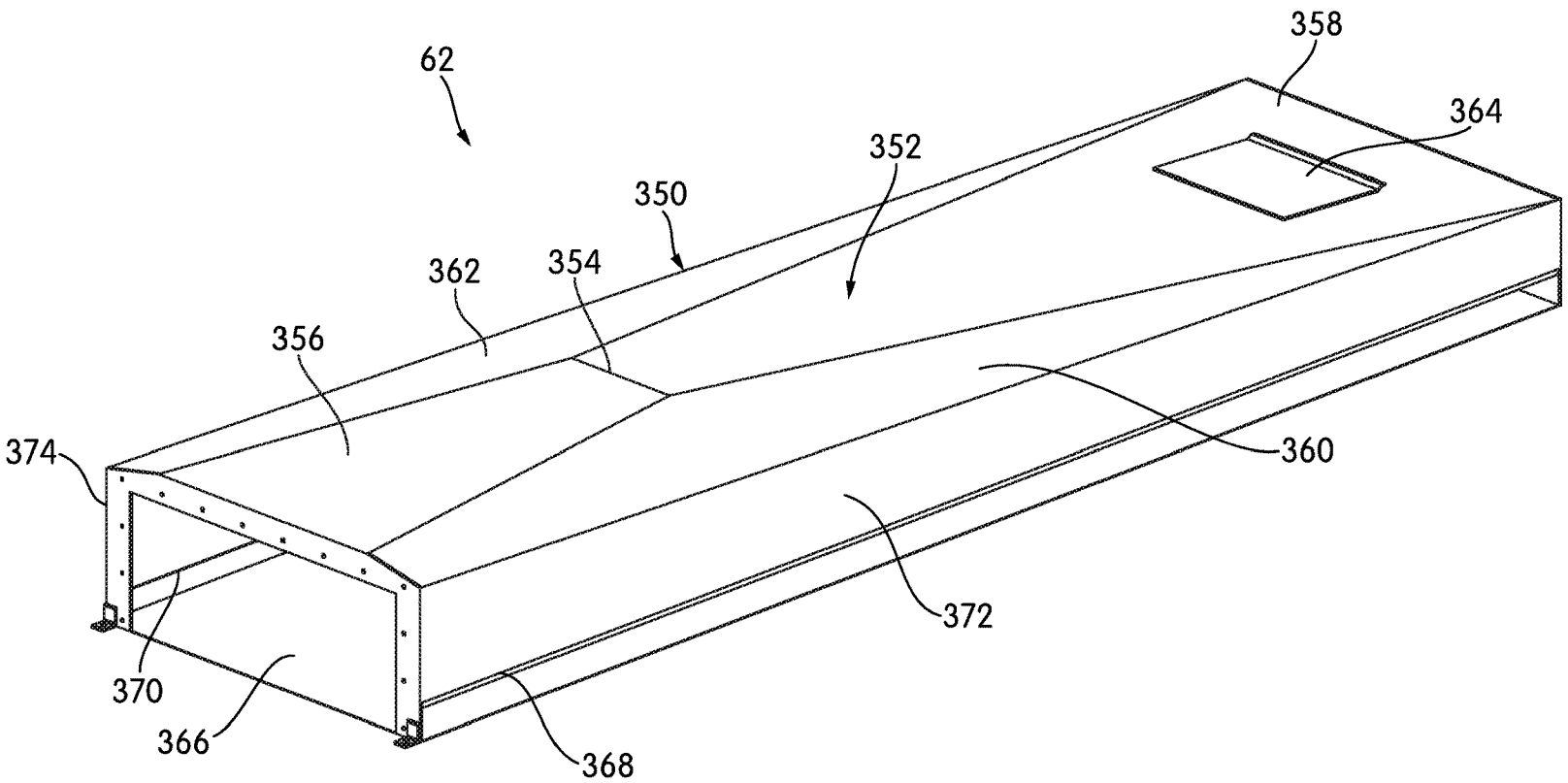
FIG. 12 is a perspective view of a fifth dust hood.

FIG. 12 is a perspective view of dust hood 62, which, as described above, is typically located under the belt 42, at or very near floor level. Dust hood 62 has a body 350 that has the general shape of a rectangular prism with a sloped roof 352. The roof 352 is less severe than that of hood 34, but performs the same function of driving deposited dust down toward the inlets. In the case of hood 62, the roof 352 may also provide clearance for the belt 42, which passes over it with, e.g., about 10 inches of clearance.

The roof 352 is comprised of four portions that meet at an off-center peak line 354 and slope down from there toward the sides of the roof 352. Two trapezoidal portions 356, 358 of unequal length slope down from the peak line 354 along the length of the hood body 350; the other two portions 360, 362 slope down toward the side edges of the roof 352. The four portions 356, 358, 360, 362 have a constant slope. The peak line 354 is located approximately ⅓ of the width of the hood 62 from the outlet end. The roof 352 also includes a cleaning hatch 364.

The outlet 366 is located at the end of the hood body 350 closest to the peak line 354. Hood 62 includes two inlets 368, 370 opposite one another, one in each long side face 372, 374 of the hood body 350. The inlets 368, 370 have a constant height across the width of the hood body 350. The hood body 350 itself may be, e.g., about 159 inches (404 cm) in width, 43.75 inches (111 cm) deep, and have a maximum height of 18 inches (45.7 cm). In a typical embodiment, hood 62 would move, e.g., 22,000 CFM (623 $m^3$/min) of air through its inlets 368, 370.

The hoods 28, 30, 34, 50, 62 would generally be made of a metal, and particularly, a metal or alloy that can withstand moisture, high pressure, and relatively high temperature without undue corrosion. For at least some embodiments, 12-gauge 304 stainless steel sheet is an appropriate material.

Much of the description above assumes that the hoods 28, 30, 34, 50, 62 have hollow interiors; however, the interiors of the hoods 28, 30, 34, 50, 62 may be reinforced. For example, due to its position and the high flow volume through its inlets 368, 370, the roof 352 of hood 62 may be reinforced to prevent vibration.

In the hoods 28, 30, 34, 50, 62 described above, the inlet is usually a slit that varies in size across the width of the hood. In some cases, larger scraps of paper may break free or clumps of dust may accumulate that are larger than the various inlets. If this occurs, the hood 28, 30, 34, 50, 62 or hoods in question may be equipped with a variable-size inlet, as disclosed in U.S. Pat. No. 9,725,852, that can expand temporarily to accommodate these larger clumps.

As was described above, the dust from papermaking machines can be sticky, in part because adhesive compounds are used to temporarily bind the web 18 to structures like the Yankee cylinder 12 and to repair the web 18 in case of breaks. Sometimes these compounds are adhesives like PvOH; sometimes, more prosaic substances, like molasses, may be used. In order to deal with the stickiness of dust, some of the hoods 30, 34 have sharp roofs and other adaptations, and all of the hoods have some sort of hatch for cleanout.

Unfortunately, the problem of sticky dust does not end at the inlet to a hood; the entire system should be designed with sticky dust in mind. For that reason, the transport velocity of the air within the ducts should be high enough to prevent internal accumulation of dust. Because of the stickiness of the dust in question, an air velocity (i.e., transport velocity) of at least 5,500 feet per minute (28 m/s) within the ductwork has been found to be sufficient to prevent accumulation in most cases, although for ducts connecting to the highest airflow hoods, duct velocities of 6,000 feet per minute (30.5 m/s) or 6,200 feet per minute (31.5 m/s) may be needed. Duct sizes can be calculated by considering the airflow volume at each hood 28, 30, 34, 50, 62, the size of each hood outlet, and the desired transport velocity within the duct.

While the invention has been described with respect to certain embodiments, the description is intended to be exemplary, rather than limiting. Modifications and changes may be made within the scope of the invention, which is defined by the appended claims.

What is claimed is:

1. A dust hood, comprising:

a hood body having a roof and first and second long sidewalls that depend from opposite edges of the roof, the roof forming a peak line;

a first inlet extending substantially the entirety of the first long sidewall, the first inlet having a substantially constant height;

a second inlet extending substantially the entirety of the second long sidewall, the second inlet having a substantially constant height; and an outlet.

2. The dust hood of claim 1, wherein the roof of the hood body comprises four angled segments that meet at the peak line.

3. The dust hood of claim 2, wherein the four angled segments are trapezoidal in shape.

4. The dust hood of claim 3, wherein the peak line is closer to a first end of the hood body than to a second end of the hood body.

5. The dust hood of claim 1, wherein the outlet is located at a first end of the hood body.

6. The dust hood of claim 4, wherein the peak line is closer to the first end of the hood body than to a second end of the hood body that is opposite the first end.

7. A dust collection system, comprising:

a dust hood including a hood body having a roof and first and second long sidewalls that depend from opposite edges of the roof, the roof forming a peak line, a first inlet extending substantially the entirety of the first long sidewall, the first inlet having a substantially constant height, a second inlet extending substantially the entirety of the second long sidewall, the second inlet having a substantially constant height, and an outlet; and one or more air ramps spaced from the dust hood and arranged to drive dust toward the first inlet or the second inlet.

8. The dust collection system of claim 7, wherein the roof of the hood body comprises four angled segments that meet at the peak line.

9. The dust collection system of claim 8, wherein the four angled segments are trapezoidal in shape.

10. The dust collection system of claim 9, wherein the peak line is closer to a first end of the hood body than to a second end of the hood body.

11. The dust collection system of claim 7, wherein the outlet is located at a first end of the hood body.

12. The dust hood of claim 11, wherein the peak line is closer to the first end of the hood body than to a second end of the hood body that is opposite the first end.

* * * * *